US009723969B2

(12) United States Patent
Gursoy et al.

(10) Patent No.: US 9,723,969 B2
(45) Date of Patent: Aug. 8, 2017

(54) WASHER COMPRISING A LIQUID DETERGENT DOSING UNIT

(71) Applicant: ARCELIK ANONIM SIRKETI, Istanbul (TR)

(72) Inventors: Hasret Gursoy, Istanbul (TR); Mehmet Diksan, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/758,798

(22) PCT Filed: Dec. 30, 2013

(86) PCT No.: PCT/EP2013/078118
§ 371 (c)(1),
(2) Date: Jun. 30, 2015

(87) PCT Pub. No.: WO2014/102369
PCT Pub. Date: Jul. 3, 2014

(65) Prior Publication Data

US 2015/0335224 A1 Nov. 26, 2015

(30) Foreign Application Priority Data

Dec. 31, 2012 (TR) ..... A 2012/15780

(51) Int. Cl.
*A47L 15/42* (2006.01)
*A47L 15/44* (2006.01)

(52) U.S. Cl.
CPC ..... *A47L 15/4418* (2013.01); *A47L 15/4257* (2013.01); *A47L 15/44* (2013.01); *A47L 15/449* (2013.01); *A47L 15/4463* (2013.01)

(58) Field of Classification Search
CPC .. A47L 15/4257; A47L 15/44; A47L 15/4418; A47L 15/4463; A47L 15/449
USPC ..... 134/56 D, 57 D, 58 D, 93, 99.2
See application file for complete search history.

(56) References Cited

U.S. PATENT DOCUMENTS

2003/0106570 A1* 6/2003 Cerruti ..... A47L 15/4409 134/18

FOREIGN PATENT DOCUMENTS

| | | | |
|---|---|---|---|
| DE | 3442194 | A1 | 5/1986 |
| DE | 3812109 | A1 | 10/1989 |
| DE | 10230157 | A1 | 1/2003 |

OTHER PUBLICATIONS

Marone et al., "DE10230157A1 English Machine Translation.pdf", Jan. 16, 2003—Machine translation from Espacenet.com.*
International Search Report and written opinion for WO2014/102369 A1.

* cited by examiner

*Primary Examiner* — Michael Barr
*Assistant Examiner* — Levon J Shahinian
(74) *Attorney, Agent, or Firm* — Kilpatrick Townsend & Stockton LLP

(57) ABSTRACT

The present invention relates to a washer (100) comprising a body, a door providing access into the body, a liquid detergent tank (3) enabling liquid detergent to be stored and a detergent dosing unit (1) enabling liquid detergent corresponding to an amount estimated for one washing program to be transferred from the liquid detergent tank (3) into a washer (100) during a cycle.

19 Claims, 4 Drawing Sheets

WASHER COMPRISING A LIQUID DETERGENT DOSING UNIT

Figure 1:
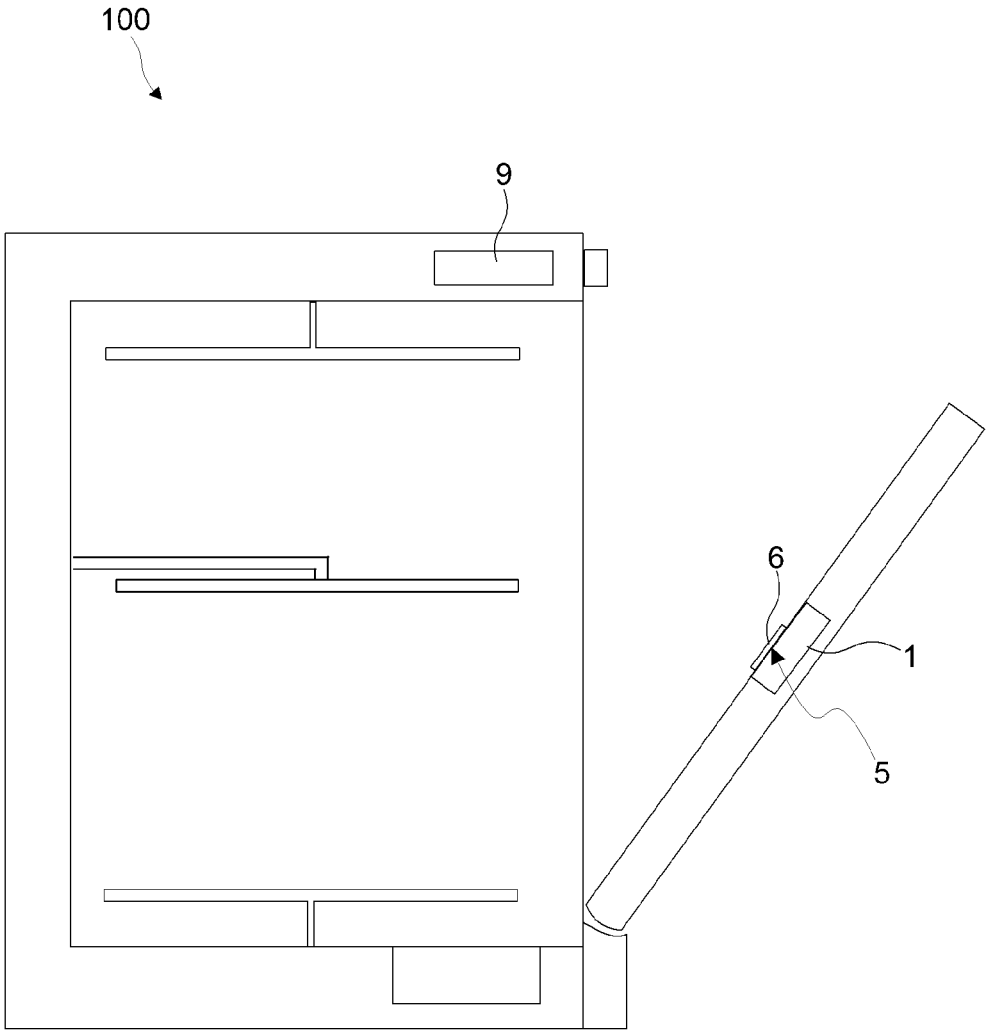

The present invention relates to a washer comprising a liquid detergent dosing unit.

The existing washers (dishwashers or washing machines) having detergent dosing units are known in the prior art. By means of the detergent dosing system, the washer can dose an amount of liquid detergent from the liquid detergent tank into the washer during a cycle and thus can start the cycle multiple times after the detergent tank is filled once by a user.

In the German Patent Application No. DE 3812109 A1, washers having detergent feeding systems are explained. But in these washers, pumps with rotating wheels are used. This causes the cost of the washer to increase.

On the other hand, present washers having detergent dosing systems that do not use a pumps with rotating wheels, are known from the prior art. In the German Patent Application No. DE 3442194 A1, such a dishwasher is explained. This dishwasher comprises a mechanism that is actuated by closing of the door and which enables a defined amount of detergent to be delivered from the liquid supply container into the detergent dispenser.

The aim of the present invention is the realization of a washer comprising a detergent dosing unit which enables the liquid detergent corresponding to an estimated amount for a washing program to be reliably dosed during a cycle.

The washer realized in order to attain the aim of the present invention and explicated in the attached claims, comprises a motor, a pump that enables liquid detergent to be transferred into the washer from the liquid detergent tank, and a detergent dosing unit comprising a lever that enables the movement generated by the motor to be transmitted to a piston thereof. In an embodiment of the present invention, the detergent dosing unit comprises a drive wheel disposed so as to rotate with the movement of the motor, and a lever disposed such that when one of its arms is started to be moved upwards by the drive wheel, the other arm is enabled to press downwards on its piston. Thus, the movement generated by the motor is enabled to be transmitted to the piston.

In an embodiment of the present invention, the drive wheel comprises at least one or more than one protrusion fixed on the drive wheel, each enabling an arm of the lever to be pressed upwards as the drive wheel rotates. Thus, the lever arm is enabled to be moved by the protrusions on the drive wheel without being fixed on the drive wheel.

In an embodiment of the present invention, the drive wheel comprises four protrusions disposed at equal intervals around its periphery. Thus, as the motor makes one rotation, detergent dosing from the liquid detergent tank is enabled to be made four times into the washer.

In an embodiment of the present invention, the lever is composed of one long and one short arm. The long arm of the lever is disposed so as to be moved upwards by the drive wheel and the short arm to press downwards on its piston. Thus, the force applied on the piston is enabled to be high. Additionally, pressing on the piston is made safer since the angular movement of the short arm is limited.

In an embodiment of the present invention, the liquid detergent tank is disposed inside the door so as to be filled from a filling opening with a cover situated at the inner side of the door. Thus, the user is enabled to easily fill the liquid detergent tank from the inner side of the cover.

In an embodiment of the present invention, the washer comprises a control unit which enables the liquid detergent unit to transfer the liquid detergent corresponding to an estimated amount for the selected washing program into the washer. Thus, consumption of the liquid detergent is realized in accordance with the selected washing program.

In an embodiment of the present invention, the control unit controls the total number of rotations or the total rotation time of the motor in the detergent dosing unit and one or more moments when the motor starts rotating, depending on the selected washing program and a detergent type predetermined or selected by a user for delivering the liquid detergent corresponding to the amount estimated for the washing program selected from the control panel. Thus, the detergent dosing unit is enabled to be controlled depending on the selected program and the type of detergent.

In an embodiment of the present invention, the user can select the type of liquid detergent he/she fills into the washer. Consequently, the detergent dosing unit is enabled to perform dosing effectively in the manner determined by the selected program even in the case the user changes the detergent type.

The model embodiments relating to the washer realized in order to attain the aim of the present invention are illustrated in the attached figures, where:

FIG. 1—is the schematic view of the washer in an embodiment of the present invention.

Figure 2:
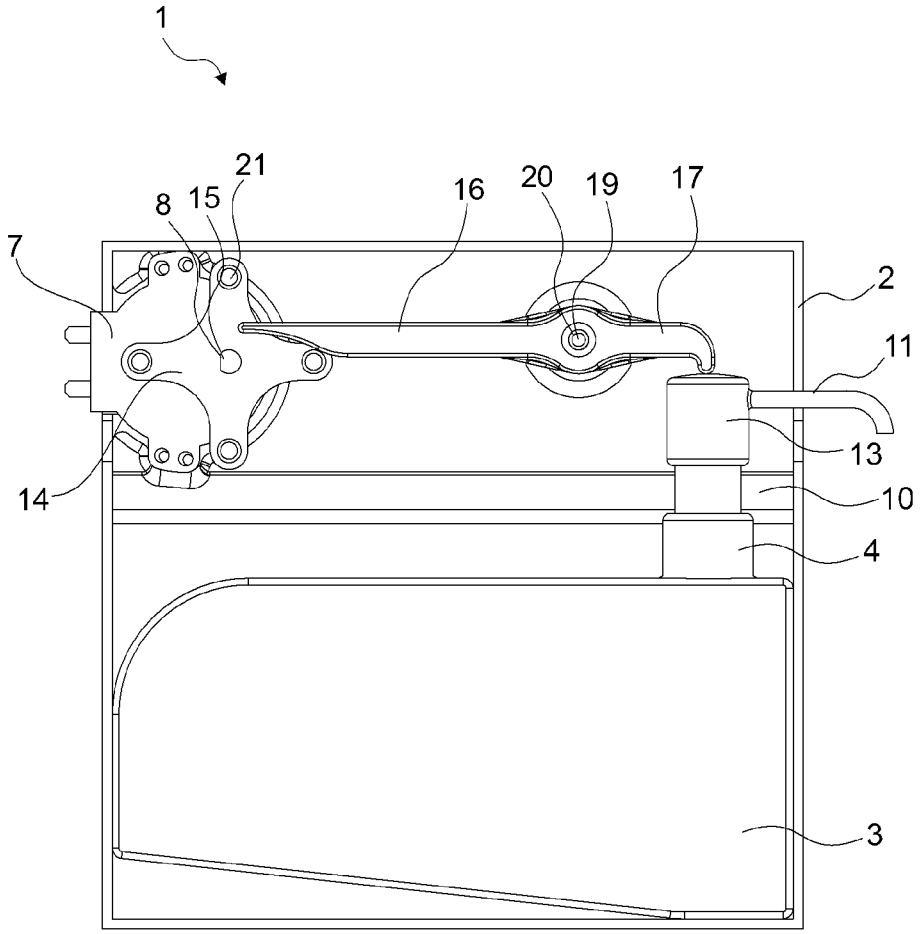

FIG. 2—is the schematic view of the detergent dosing unit in an embodiment of the present invention.

Figure 3:
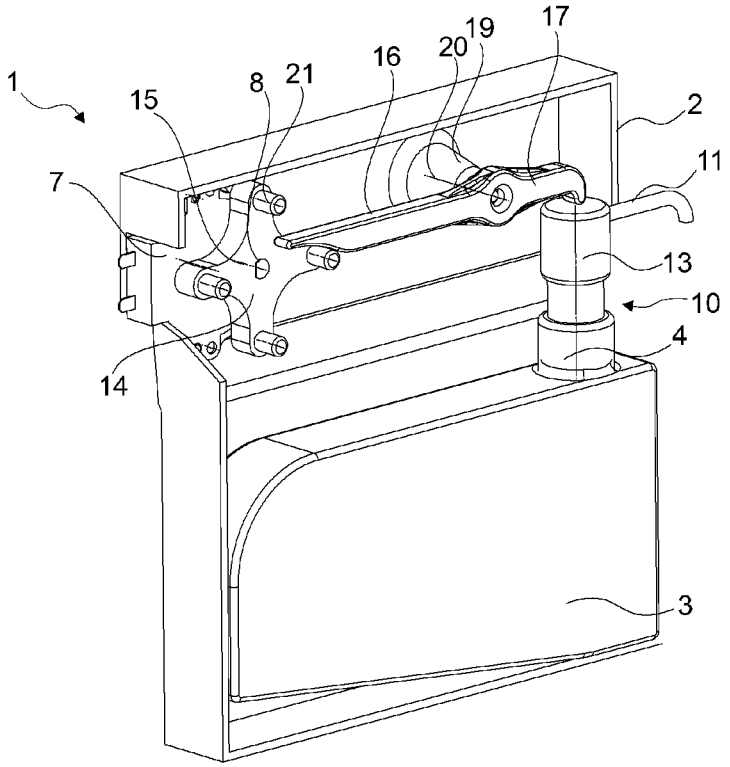

FIG. 3—is the perspective view of the detergent dosing unit in an embodiment of the present invention.

Figure 4:
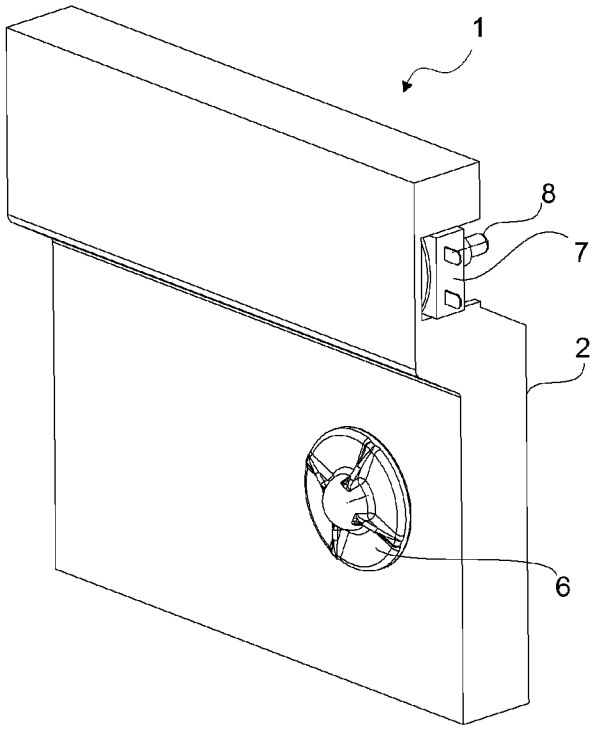

FIG. 4—is another perspective view of the detergent dosing unit in an embodiment of the present invention.

Figure 5:
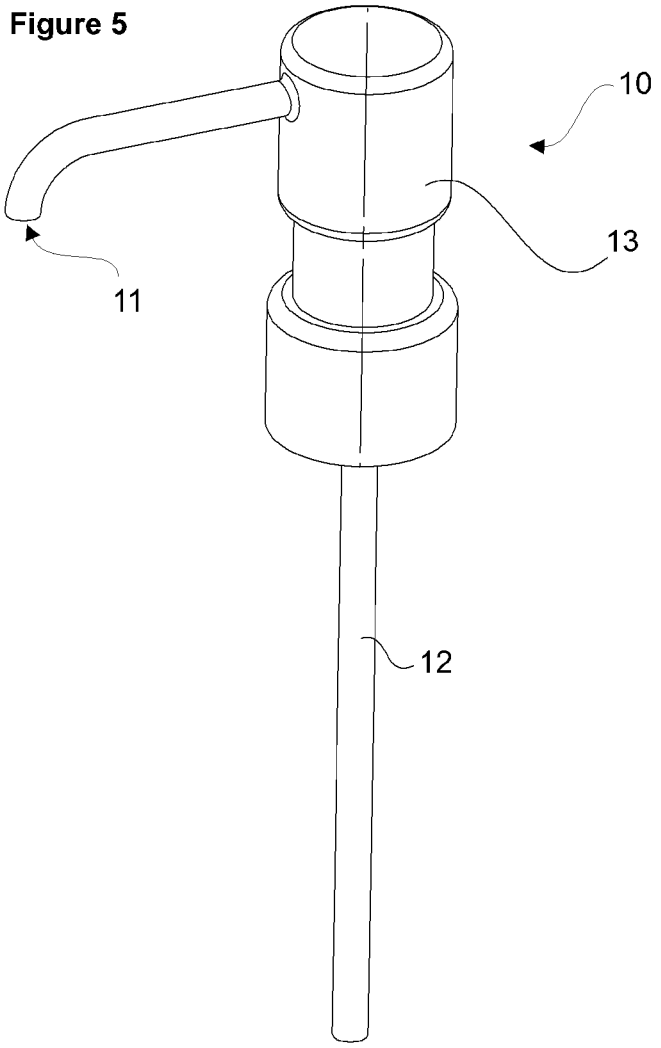

FIG. 5—is the perspective view of the detergent pump in an embodiment of the present invention.

Figure 6:
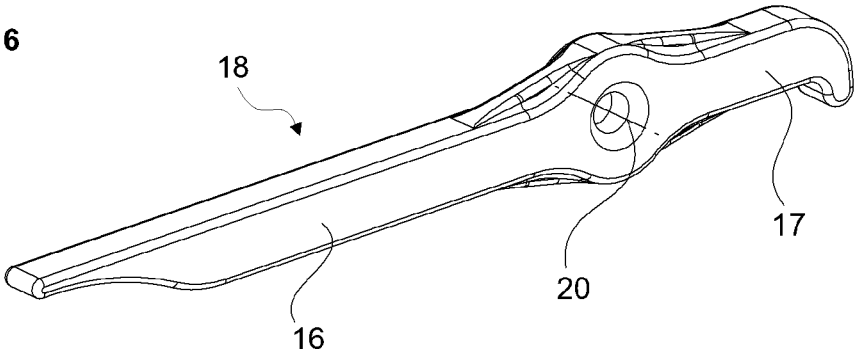

FIG. 6—is the perspective view of the lever arm in an embodiment of the present invention.

The elements illustrated in the figures are numbered as follows:

1. Detergent dosing unit
2. Receptacle
3. Liquid detergent tank
4. Pump inlet
5. Filling opening with cover
6. Cover
7. Motor
8. Motor shaft
9. Control unit
10. Pump
11. Detergent outlet
12. Detergent suction duct
13. Piston
14. Drive wheel
15. Rotational axis of the drive wheel
16. Long arm of lever
17. Short arm of lever
18. Lever arm
19. Fulcrum point of lever
20. Rotational axis of lever
21. Protrusions of the drive wheel
100. Washer A washer (100), not shown in the figures, comprises a body, a door providing access into the body, a liquid detergent tank (3) enabling liquid detergent to be stored, a detergent dosing unit (1) enabling liquid detergent corresponding to an amount estimated for one washing program to be transferred from the liquid detergent tank (3) thereinto during one cycle and a receptacle (2) wherein the liquid detergent tank (3) and the detergent dosing unit (1) are disposed (FIG. 1).

The detergent dosing unit (1) furthermore comprises a motor (7), a pump (10) that enables the liquid detergent to be delivered from the detergent tank (3) into the washer (100), a drive wheel (14) disposed so as to rotate counterclockwise with the movement of the motor (7) and that enables the motion generated by the motor (7) to be transmitted to the piston (13) of the pump (10), a lever (18) disposed such that as one of its arms (16) is started to be moved upwards by the drive wheel (14), the other arm (17) is enabled to press the piston (13) of the pump (10) downwards (FIG. 1). Thus, the motion generated by the motor (7) is enabled to be transmitted to the piston (13) of the pump (10). The drive wheel (14) is attached onto a shaft (8) of the motor (7) (FIG. 7 and FIG. 8). As the piston (13) is pressed downwards, the liquid detergent is sucked and filled from a suction duct (12) of the pump (10) and is delivered into the washer (100) from a detergent outlet (11) of the pump (10). As the piston (13) is pushed back to its free position by the spring means, some amount of liquid detergent from the detergent tank (3) fills in via the suction duct (12). The said pump (10) that functions according to the operating principle of a waterpump is known in the technique. Therefore, a more detailed explication of the pump (10) used in the present invention is not necessary. The pump (10) used in the present invention is inserted into an inlet of the detergent tank (3) and can be firmly fixed there.

In an embodiment of the present invention, the drive wheel (14) comprises at least one or more than one protrusion (21) fixed on the drive wheel (14) and each enabling an arm (16) of the lever (18) to be pressed upwards as the drive wheel (14) rotates counterclockwise (FIG. 2). The lever (18) is fixed to a fulcrum point (19) so as to rotate freely around an axis (20) (FIG. 2). Thus, the lever (18) is enabled to be set in motion by the drive wheel (14). The part of the lever (18) touching the protrusions (21) on the drive wheel (14) is preferably configured to be inclined towards the movement direction and in tapering form. Thus, the lever (18) is enabled to function more harmoniously with the protrusions (21) and to move softly. Another spring, not shown in the figures, is preferably used for the lever (18) to return easily to the horizontal position.

In an embodiment of the present invention, the drive wheel (14) comprises four protrusions (21) disposed around its periphery at equal intervals (FIG. 2 and FIG. 7). Thus, as the motor (7) makes one rotation, the pump (10) is enabled to perform dosing of detergent four times from the liquid detergent tank (3) into the washer (100). The said protrusions (21) preferably have cylindrical cross-sections and extend in the rotational axis (15) direction of the drive wheel (14) (FIG. 2). The drive wheel (14) and the protrusions (21) can be produced from a single material or can be produced separately and joined afterwards. The drive wheel (14), the protrusions (21) and the lever arm (18) are produced from metal or preferably from a suitable artificial material so that the friction occurring therebetween is low.

In an embodiment of the present invention, the lever (18) is composed of one long arm (16) and one short arm (17) (FIG. 6). The lever (18) is disposed on a fulcrum point (19) such that the long arm (16) is moved by the drive wheel (14) and the short arm (17) presses on the piston (13) of the pump (10) downwards (FIG. 1, FIG. 2 and FIG. 6). Thus, the force applied on the piston (13) of the pump (10) is enabled to be high. Additionally, pressing on the piston (13) is made to be more accurate since the angular movement of the short arm (17) is limited.

In an embodiment of the present invention, the washer (100) comprises a filling opening (5) at the inner side of its door and a filling cover (6) that covers the filling opening (5). The liquid detergent tank (3) is disposed inside the door so as to be filled from the filling opening (5) situated at the inner side of the door (FIG. 3). Thus, the user is enabled to fill the liquid detergent tank (3) from the inner side of the washer (100) door. Preferably, at least one or more than optical sensor, not shown in the figures, is used in order to inform the user about the fill rate of the liquid detergent tank (3). Thus, the user is enabled to see the fill rate of the liquid detergent tank (3) from a control panel, not shown in the figures. In an embodiment of the present invention, the washer (100) comprises a control unit (9). The control unit (9) controls the total number of rotations or the total rotation time and the rotation start time of the motor (7) in the detergent dosing unit (1) and the dosing number in order to transfer the liquid detergent corresponding to an amount estimated for the selected washing program into the washer (100). The control unit (9) determines the form of the control signal applied to the motor (7) in the detergent dosing unit (1) depending on the total rotation number or the total rotation time and one or more than one moment when the motor (7) starts rotating. Thus, the detergent dosing unit (1) is enabled to be controlled depending on the selected program and the type of detergent.

In another embodiment of the present invention, the rotation number of the motor (7) is feed backed to the control unit (9) by a sensor disposed in the detergent dosing unit (1). Thus, the motor (7) is enabled to be controlled reliably.

In an embodiment of the present invention, the control unit (9) determines the amount of detergent estimated for each washing program according to the detergent type as the whole multiples of the motor (7) rotation number or time. A reference table related to this is kept in a permanent memory, not shown in the figures, that is disposed in the control unit (9). The control unit (9) applies the control signal to the motor (7) in the required form during the cycle by reading the necessary data from the memory in accordance with the selected washing program and the detergent type. Thus, an effective control method is provided in order to utilize the detergent dosing unit (1) with different washing programs.

In another embodiment of the present invention, after detecting the load amount and the dirt level, whole multiples read from the memory and corresponding to the selected washing program, are changed proportionately by the control unit (9). Consequently, use of less detergent is provided in low load amount and/or less dirtiness level and use of more detergent in greater load amount and/or excessive dirtiness level.

In an embodiment of the present invention, the user can select the type of liquid detergent filled into the washer (100) from the control panel. In order to perform this, the user is enabled to select the detergent type corresponding to the code specified on the liquid detergent package and enter to the washer (100).

In another embodiment of the present invention, the user is enabled to enter the detergent type by bringing a radio frequency memory element, supplied together with the liquid detergent package, near the washer (100).

By means of the present invention, a washer (100) having a detergent dosing unit (1) is realized, which is low cost, structurally simple, easy to maintain and repair when required and which can dose precisely and reliably the liquid detergent corresponding to an estimated amount for a washing program during a cycle, and that can be controlled according to user requirements, allowing saving of detergent.

The invention claimed is:

1. A washer (100) comprising a body, a door providing access into the body, a liquid detergent tank (3) enabling liquid detergent to be stored, a detergent dosing unit (1) enabling liquid detergent corresponding to an amount estimated for one washing program to be transferred from the liquid detergent tank (3) into the washer (100) during a cycle, wherein the detergent dosing unit (1) comprises a motor (7), a pump (10) that enables liquid detergent to be delivered from the liquid detergent tank (3) into the washer (100), a drive wheel (14) disposed so as to rotate counterclockwise as the motor (7) operates and a lever (18) that contacts and applies a downward force on an upper portion of a piston (13) of the pump (10) when activated by the drive wheel (14), wherein when the downward force is applied on the upper portion of the piston, the pump sucks the liquid detergent from the liquid detergent tank (3) and delivers the liquid detergent into the washer.

2. The washer (100) as in claim 1, wherein the lever (18) comprises a long arm (16) and a short arm (17), wherein the long arm is longer than the short arm, wherein the short arm (17) is enabled to press downwards on the piston (13) of the pump (10) as a terminal end of the long arm (16) is engaged by the drive wheel (14).

3. The washer (100) as in claim 2, further comprising a filling opening (5) arranged at an inner side of the door and a filling cover (6) that covers the filling opening (5) and the liquid detergent tank (3) that is disposed inside the door so as to be filled from the filling opening (5).

4. The washer (100) as in claim 2, further comprising a control unit (9) configured to control a total number of rotations or a total rotation time and a rotation start time of the motor (7) in the detergent dosing unit (1) and a dosing number in order to transfer liquid detergent corresponding to an amount estimated for a selected washing program into the washer (100).

5. The washer (100) as in claim 1, wherein the drive wheel (14) comprises at least one protrusion (21) disposed on the drive wheel (14), each protrusion engages a terminal end of an arm (16) of the lever to push the arm upwards when the protrusion comes into contact with the terminal end of the arm as the drive wheel (14) rotates.

6. The washer (100) as in claim 5, wherein the drive wheel (14) comprises four protrusions (21) disposed on a periphery of the drive wheel (14) at equal intervals.

7. The washer (100) as in claim 6, wherein the lever (18) composed of one long arm (16) and one short arm (17), and disposed such that a terminal end of the long arm (16) is engaged and moved by the drive wheel (14) and the short arm (17) presses on the piston (13) of the pump (10), wherein the long arm is longer than the short arm.

8. The washer (100) as in claim 7, further comprising a filling opening (5) arranged at an inner side of the door and a filling cover (6) that covers the filling opening (5) and the liquid detergent tank (3) that is disposed inside the door so as to be filled from the filling opening (5).

9. The washer (100) as in claim 7, further comprising a control unit (9) configured to control a total number of rotations or a total rotation time and a rotation start time of the motor (7) in the detergent dosing unit (1) and a dosing number in order to transfer liquid detergent corresponding to an amount estimated for a selected washing program into the washer (100).

10. The washer (100) as in claim 6, further comprising a filling opening (5) arranged at an inner side of the door and a filling cover (6) that covers the filling opening (5) and the liquid detergent tank (3) that is disposed inside the door so as to be filled from the filling opening (5).

11. The washer (100) as in claim 6, further comprising a control unit (9) configured to control a total number of rotations or total rotation time and a rotation start time of the motor (7) in the detergent dosing unit (1) and a dosing number in order to transfer liquid detergent corresponding to an amount estimated for a selected washing program into the washer (100).

12. The washer (100) as in claim 5, wherein the lever (18) is composed of one long arm (16) and one short arm (17), and disposed such that a terminal end of the long arm (16) is engaged and moved by the drive wheel (14) and the short arm (17) presses on the piston (13) of the pump (10), wherein the long arm is longer than the short arm.

13. The washer (100) as in claim 12, further comprising a filling opening (5) arranged at an inner side of the door and a filling cover (6) that covers the filling opening (5) and the liquid detergent tank (3) that is disposed inside the door so as to be filled from the filling opening (5).

14. The washer (100) as in claim 12, further comprising a control unit (9) configured to control a total number of rotations or a total rotation time and a rotation start time of the motor (7) in the detergent dosing unit (1) and a dosing number in order to transfer liquid detergent corresponding to an amount estimated for a selected washing program into the washer (100).

15. The washer (100) as in claim 5, further comprising a filling opening (5) arranged at an inner side of the door and a filling cover (6) that covers the filling opening (5) and the liquid detergent tank (3) that is disposed inside the door so as to be filled from the filling opening (5).

16. The washer (100) as in claim 5, further comprising a control unit (9) configured to control a total number of rotations or a total rotation time and a rotation start time of the motor (7) in the detergent dosing unit (1) and a dosing number in order to transfer liquid detergent corresponding to an amount estimated for a selected washing program into the washer (100).

17. The washer as in claim 1, wherein the pump is configured such that the liquid detergent is sucked and filled from a suction duct of the pump and is delivered into the washer from a detergent outlet of the pump as the piston of the pump is pressed in a first direction.

18. The washer (100) as in claim 1, wherein the drive wheel (14) comprises a plurality of protrusions (21) disposed on the drive wheel (14), each protrusion engages and pushes upwards a terminal end of the lever when the protrusion comes into contact with the terminal end of the lever as the drive wheel (14) rotates while an opposite end of the lever applies the downward force on the upper portion of a piston (13) of the pump (10) thereby delivering one dose of the liquid detergent into the washer.

19. The washer (100) as in claim 18, wherein a number of protrusions of the drive wheel (14) corresponds to a number of liquid detergent doses delivered into the washer as the motor makes one rotation.

* * * * *